US008128017B2

(12) United States Patent
Naulet et al.

(10) Patent No.: US 8,128,017 B2
(45) Date of Patent: Mar. 6, 2012

(54) RELEASED MOTION WINDING MACHINE FOR THERMOPLASTIC FIBRES

(75) Inventors: Christophe Naulet, Chambery (FR); Jean-Marc Bouvier, Barberaz (FR); Jerome Vollet, Chambery (FR)

(73) Assignee: Saint-Gobain Technical Fabrics Europe, Chambery (FR)

( * ) Notice: Subject to any disclaimer, the term of this patent is extended or adjusted under 35 U.S.C. 154(b) by 0 days.

(21) Appl. No.: 10/542,300

(22) PCT Filed: Jan. 22, 2004

(86) PCT No.: PCT/FR2004/000137

§ 371 (c)(1),
(2), (4) Date: Nov. 30, 2005

(87) PCT Pub. No.: WO2004/067426

PCT Pub. Date: Aug. 12, 2004

(65) Prior Publication Data

US 2006/0214046 A1 Sep. 28, 2006

(30) Foreign Application Priority Data

Jan. 22, 2003 (FR) ..... 03 00812

(51) Int. Cl.
*B65H 67/048* (2006.01)

(52) U.S. Cl. ..... 242/474.5

(58) Field of Classification Search ..... 242/479.5, 242/479.6, 479.8, 480.2, 476.8, 472.8, 474.5
See application file for complete search history.

(56) References Cited

U.S. PATENT DOCUMENTS

| | | | | |
|---|---|---|---|---|
| 2,932,461 | A | 4/1960 | Kimberly | |
| 3,041,663 | A * | 7/1962 | Green | 156/167 |
| 3,090,570 | A | 5/1963 | Cunningham et al. | |
| 4,054,249 | A | 10/1977 | Klink et al. | |
| 4,065,065 | A | 12/1977 | Kallenborn | |
| 4,431,138 | A | 2/1984 | Schiminski et al. | |
| 4,511,095 | A * | 4/1985 | Ideno et al. | 242/474.3 |
| 5,016,829 | A * | 5/1991 | Schippers et al. | 242/474.6 |
| 5,156,347 | A | 10/1992 | Gay, II et al. | |
| 5,526,995 | A | 6/1996 | Westrich et al. | |
| 6,105,896 | A * | 8/2000 | Westrich | 242/474.5 |

FOREIGN PATENT DOCUMENTS

| | | |
|---|---|---|
| FR | 1 246 431 | 11/1960 |
| JP | 06-329437 | 11/1994 |

OTHER PUBLICATIONS

Translation of JP 06-329437.*

* cited by examiner

*Primary Examiner* — William E Dondero
(74) *Attorney, Agent, or Firm* — Oblon, Spivak, McClelland, Maier & Neustadt, L.L.P.

(57) ABSTRACT

A winding machine including a frame. The frame includes at least one spindle configured to support at least one cake, the spindle being movable in rotation about a first axis substantially perpendicular to the diameter of the cake, and at least one positioning and guidance device configured to position and guide at least one thread on the rotating spindle. The spindle is mounted so as to be movable linearly along the first axis of rotation.

7 Claims, 4 Drawing Sheets

RELEASED MOTION WINDING MACHINE FOR THERMOPLASTIC FIBRES

CROSS-REFERENCE TO RELATED APPLICATIONS

Figure 1A:
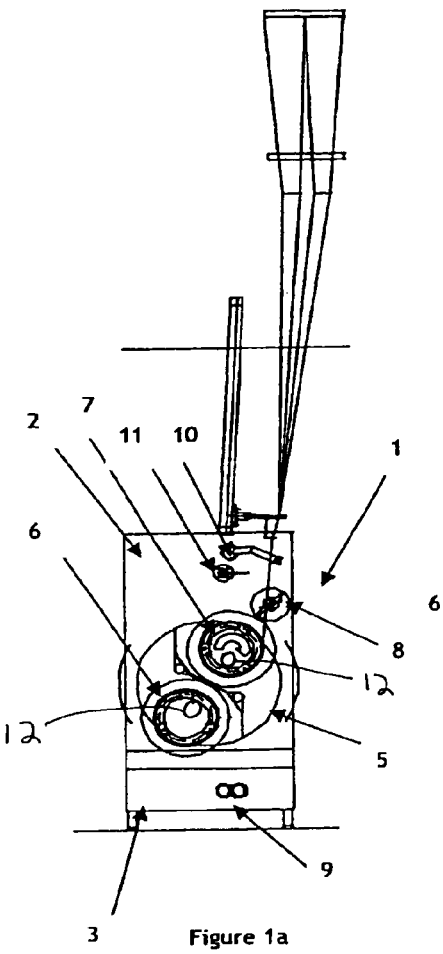

The present application is the U.S. counterpart of WO 2004/067426 and claims priority to French application no. 03/00812 filed on Jan. 22, 2003, the entire contents of each of which are hereby incorporated herein by reference.

The present invention relates to a device making it possible to ensure the drawing and winding of thermoplastic threads, in particular glass threads.

It will be remembered that the manufacture of glass reinforcing threads is the result of a complex industrial process which involves obtaining threads from streams of molten glass flowing through spinneret orifices. These streams are drawn in the form of continuous filaments, and then these filaments are gathered together in the form of ground threads, the said threads being collected in the form of wound packages.

Within the meaning of the invention, the wound packages are in the form of bobbins or, even more specifically, in the form of "cakes", these cakes being intended more particularly for reinforcing applications.

Shaping in the form of a cake is carried out with the aid of winding machines which, as their name suggests, are responsible for winding at very high speed (approximately 10 to 50 meters per second) the glass threads which have previously been sized.

These winding machines ensure the drawing and winding of these filaments, and the operating parameters of these winding machines, along with those of the spinneret, govern the dimensional characteristics of the thread, in particular the linear density expressed in tex (tex being the weight in grams of 1000 meters of fibers or threads).

Thus, to ensure a constant linear density of the thread during the entire phase of preparation of the cake, in spite of the increase in its diameter, the speed of the winding member of the winding machine is controlled in such a way as to ensure a constant linear winding speed of the thread, even though its angular speed varies, this speed control being carried out by reducing the rotational speed of the spindle supporting the cake as a function of the increasing diameter of the latter.

Another important parameter governing obtaining a cake of optimum quality is its capacity for being easily unwound, without the presence of loops or of disturbing knots, with friction being limited. This unwinding capacity is determined by the nature of the law of construction (determining the enlargement of the cake) which has been brought about by the winding machine during the formation of the cake. This law of construction incorporates numerous parameters, one of the most important of which is the crossing ratio, often called RC and the linear density of the thread.

In order to impart a given crossing ratio to a cake, the winding machines of the prior art generate kinematics or a particular stroke in the thread from the combination of two movements. A first movement, which imparts a primary stroke to the thread, and a second movement, which imparts a secondary stroke to the thread, the first and second movements generally being applied by a single combined-movement member which is known more generally by the name of a crossing device.

For practical purposes, the definition of the crossing ratio (RC) is given below:

(RC)=Rotational speed of the spindle supporting and driving the cake/rotational speed of the crossing device.

These known winding machines consist essentially of a frame, usually positioned underneath a spinneret, this frame supporting the crossing device and at least one spindle movable in rotation, this spindle being designed, on the one hand, to generate the cake and, on the other hand, to support the latter.

Conventionally, a crossing device comprises a helically shaped member, this helix movable in rotation about an axis making it possible to position the thread on the rotating spindle, the movement imparted by the helix consisting essentially of an oscillating or beating movement solely over a portion of the length of the cake, this movement constituting the primary stroke.

To obtain the full winding capacity, it is necessary that the helix or any other equivalent device, such as, in particular, a traveller movable linearly within a groove, can describe all or part of the length of the cake. For this purpose, in known winding machines, the helix is mounted movably in a relatively slow to-and-fro translational movement on a shaft integral with the frame and parallel to the axis of the spindle, this second translational movement imparting the secondary stroke to the thread and thus allowing it to cover all or part of the length of the cake.

It will be understood that, in order to describe the entire length of the cake, the thread is displaced, to form a substantially immovable point essentially located downstream of the spinneret, in a cone, the aperture of which encompasses substantially the entire length of the cake.

As regards cakes of conventional dimension and weight, these winding machines with combined primary and secondary strokes on the same axis are fully satisfactory.

However, in order to anticipate the requirements as to the increase in output of the spinnerets (generally expressed in kg/day), which, of course, result in an increase in the dimension and weight of the cakes, it is not possible to employ these kinematics governing the correct winding of the wound package (and, above all, the subsequent optimum unwinding).

In view of the increase in output of the spinnerets, it was expedient to design and develop spinnerets comprising a large number of holes (typically, several thousand). The use of these spinnerets makes it necessary to divide the spinneret into a plurality of sheets of filaments and to combine a plurality of sheets (at least two) on the same spindle axis of a winding machine, so as thereby to carry out the drawing and winding of a plurality of cakes simultaneously.

The formation of a plurality of cakes on the same spindle axis from a plurality of combined-movement crossing devices subjects the filaments coming from the same sheet and reunited within the same thread to constraints which limit the winding possibilities of current winding machines.

Thus, as constraints, it may be noted that the use of a conventional crossing device (which has a combined movement, to be precise rotation at high speed and linear translation at slower speed) leads to appreciable variations in the path of the thread between the spinneret exit point and the point of application of the thread on the cake, these variations resulting in "unequal lengths" of the threads. On account of these length differences there is a risk that thread loops detrimental to unwinding are produced, and, moreover, these differences may be prejudicial to the process upstream of the winding machine.

The present invention is therefore aimed at mitigating these disadvantages by proposing a winding device or winding machine which minimizes the differences in lengths and in tensions, this being achieved, whatever the winding capacity of the winding machine.

For this purpose, the winding machine, consisting essentially of a frame, this frame comprising at least two spindles fastened to a barrel, the said spindles being, on the one hand, designed to support at least one cake, and, on the other hand, movable in rotation about a first axis substantially perpendicular to the diameter of the cake, and at least one positioning and guidance device designed to position and guide at least one thread on the rotating spindles, the said barrel being mounted movably in rotation with respect to the frame along a third axis of rotation substantially parallel to the first axis, characterized in that the spindles are mounted so as to be movable linearly along the first axis of rotation or in that the frame co-operates with the barrel by means of an indexing device which makes it possible to control the position of the said barrel with respect to the said frame.

By means of these arrangements, and, in particular, of the uncoupling of the movements between the primary stroke of the device for the positioning and guidance of the thread and the secondary stroke of the spindle, it is possible to obtain cakes having an optimum capacity for the winding and unwinding of the glass threads.

This capacity for winding and unwinding the threads is optimum by continuously controlling the position and/or the angular speed of the barrel supporting the spindles, it being possible for this control to be carried out regardless of whether there is uncoupling or not between the primary stroke movements of the device for the positioning and guidance of the thread and of the secondary stroke movements of the spindle.

In preferred embodiments of the invention, moreover, where appropriate, one and/or the other of the following arrangements may be adopted:

- the positioning and guidance device consists essentially of at least one helix mounted movably in rotation about the second axis,
- the positioning and guidance device consists essentially of at least one wheel provided with at least one groove, this groove being designed to position and guide at least one thread, the said wheel being movable in rotation about a second axis substantially parallel to the first axis,
- the positioning and guidance device consists essentially of at least one traveller, the said traveller being designed to position and guide at least one thread and to be displaced linearly along a second axis substantially parallel to the first axis,
- the indexing device is designed to modify continuously the angular position of the barrel with respect to the frame as a function of the variation in the outside diameter of the cake, so as to permanently control the path of the thread between its exit point from the positioning and guidance device and its contact point on the periphery of the cake,
- the spindle is actuated in rotation by means of a kinematic chain comprising a motor incorporated in the said spindle,
- the winding machine comprises a device for driving the thread or thread drawer consisting essentially of at least two motor-driven rollers, the driving device being fastened to the frame of the said winding machine,
- the winding machine comprises a straight ejector designed to position the threads at the end of the spindle,
- the winding machine comprises a thread retraction device designed to grasp and displace the threads between a first position, in which the threads are in engagement with the device for the positioning and guidance of the threads, and a second position, in which the threads are retracted from the said positioning and guidance device,
- the spindle and its drive motor are integral with a linear actuator, the said actuator being designed to ensure the to-and-fro movement of the said spindle,
- the winding machine comprises a control and command device making it possible, in particular, to ensure a regulation of speed and/or of position between the primary stroke movement of the positioning and guidance device and the secondary stroke movement of at least one of the spindles.

Figure 1B:
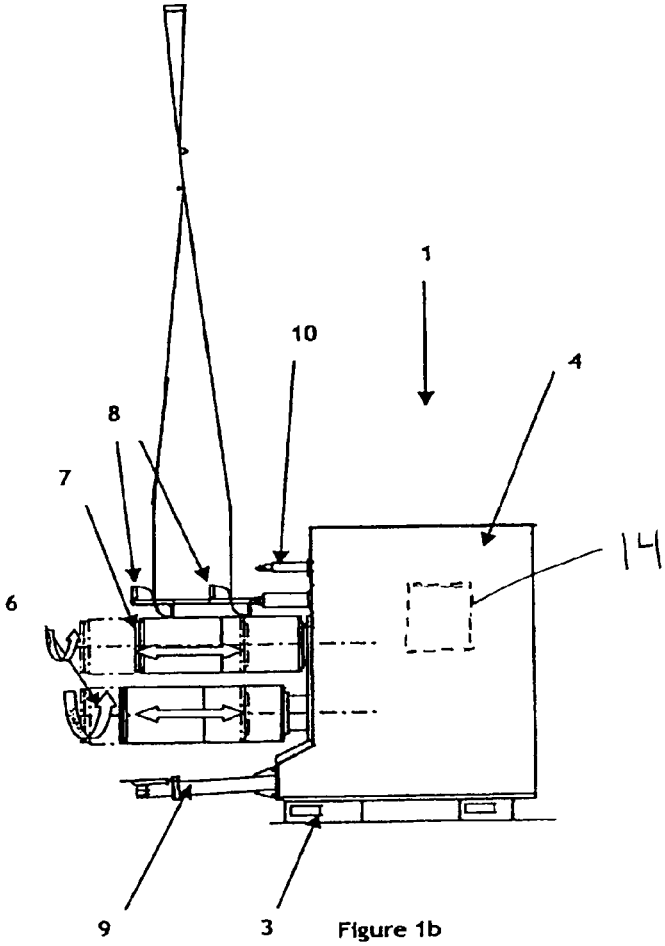
Figure 2:
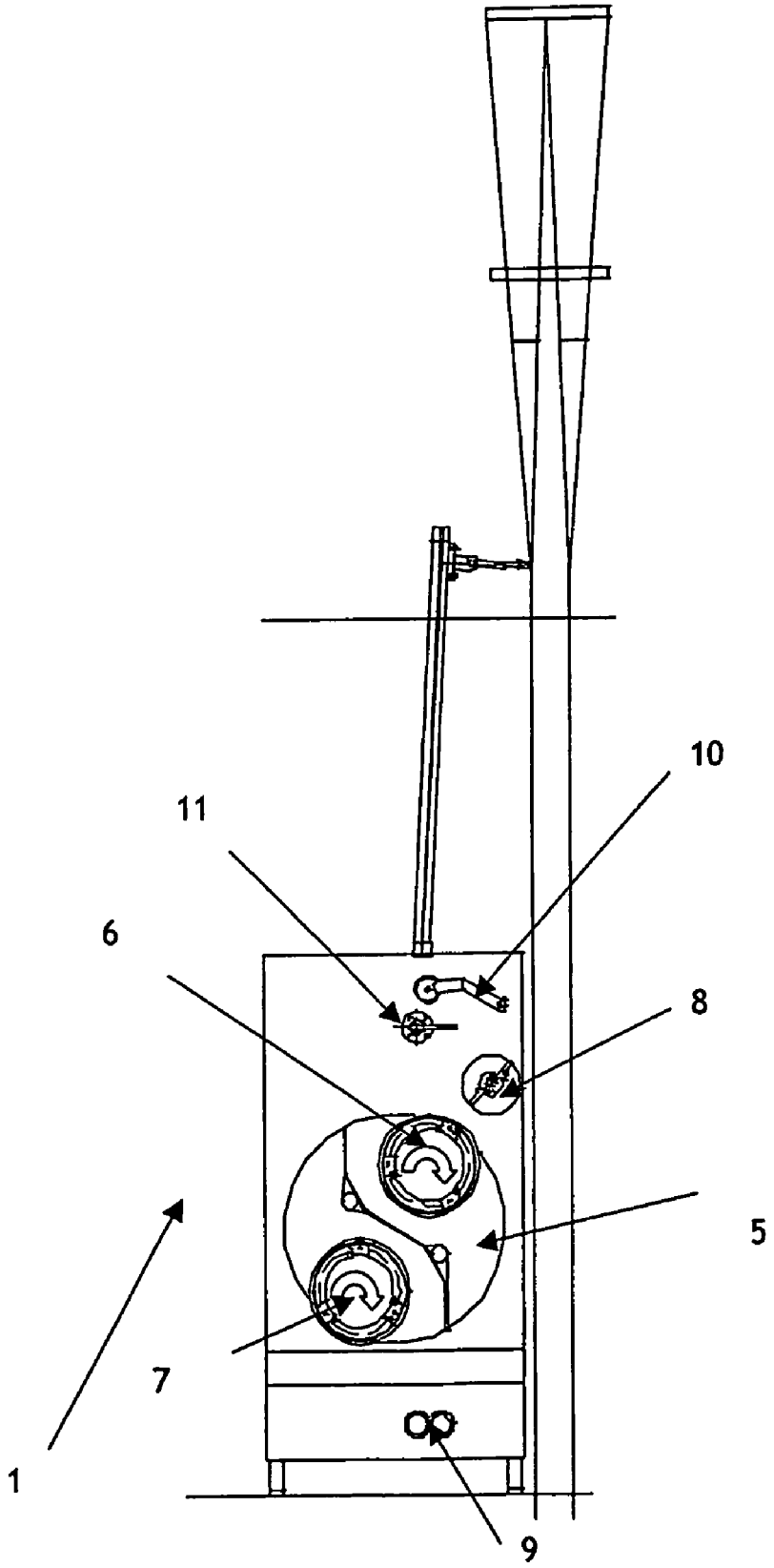
Figure 3A:
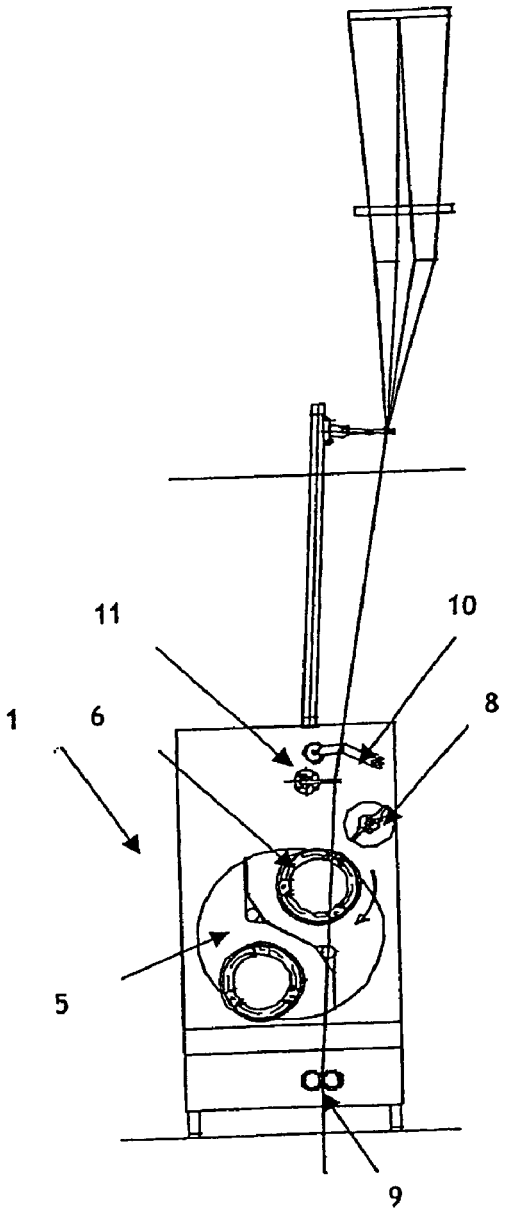
Figure 3B:
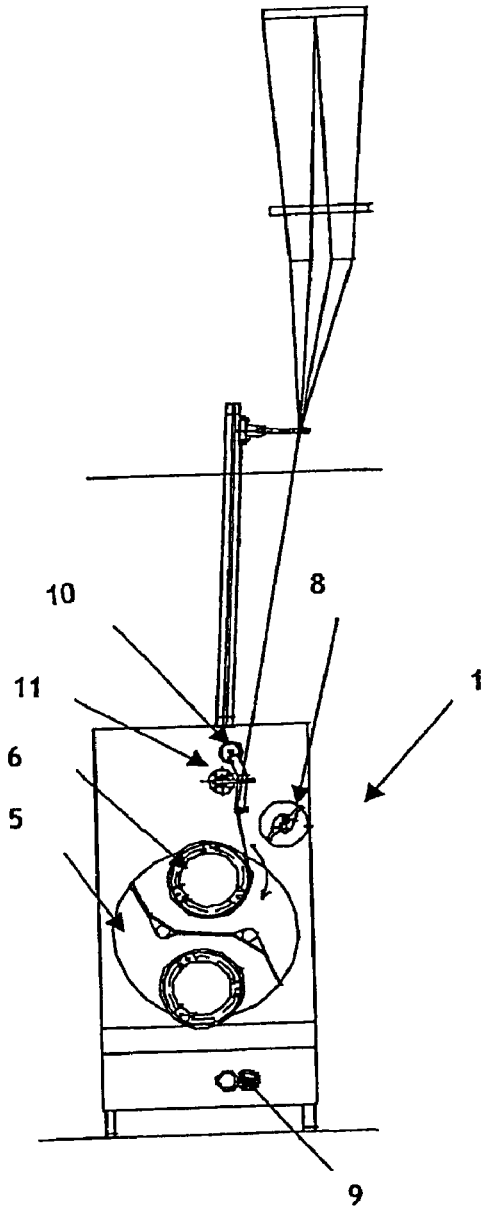
Figure 4:
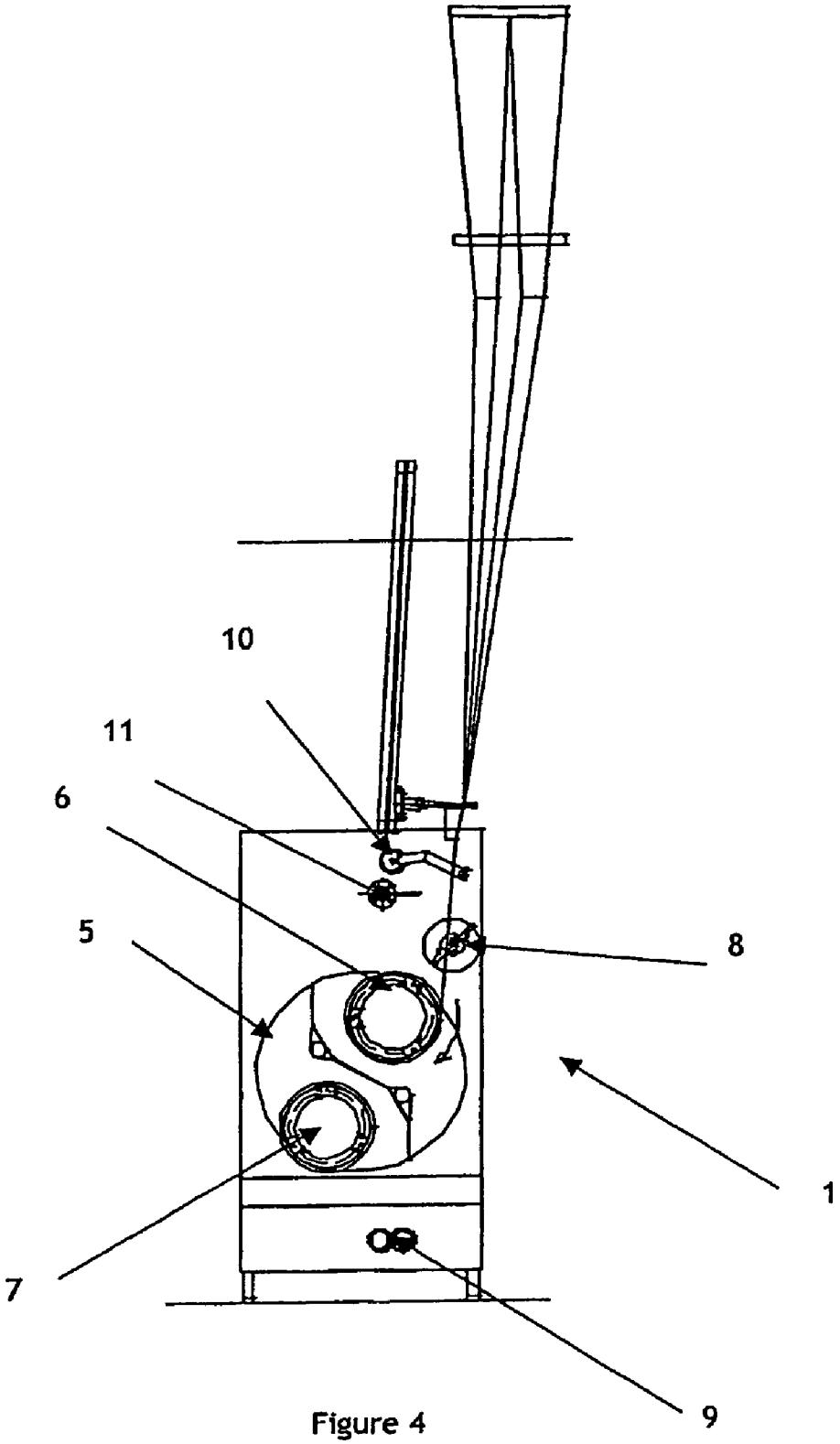

Other characteristics and advantages of the invention may be gathered from the following description of one of its embodiments given by way of non-limiting example, with reference to the accompanying drawings in which:

FIGS. 1*a* and 1*b* are respectively diagrammatic front and side views of a winding machine of the invention, FIG. 2 is a front view of the winding machine in the stand-by state, FIGS. 3*a* and 3*b* are front views of the winding machine in a start-up state, FIG. 4 is a front view of the winding machine in a winding state.

In a preferred embodiment of a winding machine 1 of the invention, illustrated in FIGS. 1*a* and 1*b*, the latter comprises a metal frame 2 obtained by means of a mechanical-welding technique of metal elements previously machined or available as standard in the trade. This frame 2 comprises essentially a substantially rectangular base 3 resting on feet carefully placed so as to match the gauge or spacing of the forks of a pallet truck or of a similar handling device, in order to make it easier to install this winding machine in a fiber-drawing position.

Assembled on this base is a partially cowled closed structure 4 which is intended for receiving all the components necessary for the operation of the winding machine 1. In this regard, and in a non-limiting way, this closed structure shaped as a cabinet is provided with the control and command devices 14 necessary for the various regulations of the various members which will be described later in the present description, and with hydraulic, electrical and compressed-air networks and networks for other fluids necessary for the operation of the said members.

A barrel 5 which projects laterally co-operates on the closed structure 4. This barrel 5 is mounted movably in rotation about an axis of rotation (called the third axis of rotation) and is held within one of the walls of the closed structure by means of a plurality of guide members (for example, ball-bearing ring, ball-bearing traveller). There is provision, moreover, for the motor drive of this barrel 5, so that it can describe and index a plurality of angular positions with respect to the frame 2 during the winding of the cakes.

To be precise, this barrel 5 forms a spindle support assembly. In FIGS. 1*a* and 1*b*, it can be seen that the barrel 5 has two spindles 6, 7, in diametrically opposed positions (it would be conceivable to have a barrel comprising at least three or four spindles, or even more, depending on the available overall size and on the capacities of the spinneret positioned upstream). Within the winding machine, the barrel 5 makes it possible to bring a previously unloaded spindle equipped with at least one empty sleeve tube (within the meaning of the invention, a sleeve tube is a support made of plastic or of cardboard which is intended for receiving the wound package of threads or the cake) into the winding position and another spindle with its sleeve tubes full into an unloading position as a result of rotations through 180° (if the barrel comprises two spindles, as may be gathered from the examples).

By means of the motor drive of the barrel 5 and of a regulation of its angular position and/or of its angular speed, for example by means of a control of the number of revolutions of the geared motor responsible for driving the barrel, this geared motor being in engagement, for example, with the barrel 5 in the region of its drive shaft by means of a connection of the gear type, it becomes possible to position the active spindle substantially in the vicinity of the thread and that the said active spindle moves back or moves away from its initial angular position during the enlargement of the cake, so as to preserve a controlled geometry.

Each of the spindles 6, 7 integral with the barrel 5 forms a rotating assembly designed for winding the thread onto a sleeve tube previously introduced onto the quill or spindle nose. This winding takes place along a first axis of rotation substantially parallel to the axis of rotation of the barrel 5 with respect to the structure of the frame 2. In addition to a rotational movement caused by a rotor motor incorporated in the spindle about this first axis, the spindle is designed to be capable of executing a to-and-fro stroke parallel to the first axis of rotation. This to-and-fro movement is caused by a motor-driven linear movement actuator 12 (for example ball screw), integral, on the one hand, with the barrel or with the frame and, on the other hand, with the body of the spindle.

Another element which is essential for the production of a cake can be seen in FIGS. 1*a* and 1*b*. This is the device 8 for the positioning and guidance of the thread on the spindle 6 or 7. In this example, this is a helix. This helix is actuated in rotation by a drive member about a shaft coaxial with a second axis substantially parallel to those mentioned above. The rotational speed of the drive member of the helix is regulated as a function of the law of construction of the cake, and there is provision for these control and command devices 14 to be incorporated within the structure 2 forming a frame.

Of course, if a plurality of cakes are to be produced simultaneously on the same spindle 6 or 7, the number of helices 8 will be adapted accordingly, and the helix support shaft will comprise a train of helices, the number of which will be equal to the number of cakes desired.

The rotational movement of the helix results, at the thread, in an oscillating or beating movement, the amplitude and frequency of which can be set as a function of the values of the desired crossing ratio. The frequency is determined as a function of the rotational speed and the amplitude as a function of the geometry of the helix.

Other devices, not illustrated in the figures, may be envisaged as a replacement for the helix. These may be a wheel provided with at least one groove, this groove being designed for positioning and guiding at least one thread, the said wheel being movable in rotation about a second axis substantially parallel to the first axis.

There may also be a traveller, the said traveller being designed to position and guide at least one thread and to be displaced linearly along a second axis substantially parallel to the first axis.

Whatever the embodiment of the device 8 for the positioning and guidance of the thread, it executes what is referred to as a primary stroke movement and functions, in terms of the regulation of speed and, where appropriate, of position, with the to-and-fro movement of the spindle 6 or 7 which constitutes what is referred to as the secondary stroke movement.

According to one advantage of the invention, the primary and secondary strokes of the winding machine 1 are uncoupled. It is possible to obtain a wide range of laws of construction and of crossing ratios, thus making it possible to manufacture cakes of large mass (between 25 and 50 kg or more) and with a highly accurate construction which is conducive to unwinding.

According to another embodiment of the invention, it is possible to obtain particular geometries by combining, simultaneously and/or in succession, the uncoupled or coupled movements of the primary and secondary strokes, with a controlled movement in the angular position and/or in the speed of the barrel supporting the spindles.

It is possible, on the winding machine which is the subject of the invention, to produce a cake which has been obtained from a single secondary stroke movement for the entire duration of winding.

Other subassemblies necessary for the operation of the winding machine 1 are incorporated within the frame 2. Thus, a thread drawer 9 is positioned in the region of the base 3 of the frame 2. A thread drawer 9 is a thread drive assembly which is used during the start-up, the start-up being a transient phase prior to a winding phase. For this purpose, the thread is drawn by means of a train of motor-driven rollers with smooth walls or with reliefs (the threads are delivered under operating conditions compatible with the engagement of the threads within the spindle nose during the starting of the winding phase).

The winding comprises at least one rotary ejector 10 and at least one straight ejector 11, these projecting laterally with respect to the closed structure 2 and in line with the barrel 5.

The rotor ejector 10 or the retraction device consists of an arm articulated at one of its ends on the closed structure of the frame 2, and its free end is designed to grasp and displace the threads between a first position, in which the threads are in engagement with the device for the positioning and guidance of the thread 8 (for example, the helix), and a second position in which the threads are retracted with respect to the said positioning and guidance device 8. The angular movement of the rotary ejector 10 is carried out during the change of spindle 6 or 7 (pivoting of the barrel 5 through 180°).

The straight ejector 11, as its name suggests, is a substantially rectilinear arm. Projecting laterally, like the rotary ejector 10, with respect to a side wall of the closed structure of the frame 2, it can occupy two positions: a position of rest, in which it retreats from the path of the thread, and a working position, in which it holds the thread above the nose of the spindle 6 or 7 during the start-up. This working position is likewise occupied during the transfer operation (rotation of the barrel, and passage from a spindle with wound cakes to a spindle with empty sleeve tubes).

In the vicinity of the device for the positioning and guidance of the thread 8 (for example, helix) is positioned a member (which cannot be seen in the figures) for cleaning the said positioning device by sprinkling with a fluid under pressure.

FIGS. 2, 3*a*, 3*b*, 4 illustrate the various states which the winding machine can occupy.

In FIG. 2, the winding machine 1 is in the stand-by state. The threads descend from the spinneret bottom and fall vertically into a reject bin. These threads escape from the winding machine in line with the spindles 6 or 7.

In FIGS. 3*a* and 3*b*, the winding machine 1 is in the start-up state. Each of the spindles 6 or 7 is provided with empty sleeve tubes (generally two or three juxtaposed). The operator grasps the threads which emerge from the spinneret bottom and directs them towards the thread drawer 9. The drive rollers of the thread drawer 9 grip the threads and draw the threads until these are brought under conditions suitable for starting (FIG. 3*a*).

The straight ejector 11 is in the working position, in order to make it possible to engage the threads within hooks or the like present at the end and on the periphery of the nose of the spindle 6 or 7.

The motor for rotating the spindle 6 or 7 provided with the sleeve tubes is started, and the control and command device 14 for the primary and secondary strokes, and for the position of the barrel, is initialized (execution of the law of construction).

At this stage, the straight ejector 11 is returned to the position of rest, and the threads are positioned directly on the sleeve tubes (refer to FIG. 3*b*).

FIG. 4 illustrates the winding state. The spindle has reached its initial winding speed. The straight ejector 11 is in the retracted position (state of rest), and the rotary ejector 10 executes an angular movement, so as to bring the threads into contact with the device 8 for the positioning and guidance of the threads (for example, helix), in such a way that it can generate its primary stroke.

As the winding progresses (as the increase in thickness of threads in the region of the cakes progresses), the barrel 5 carries out an angular correction by rotation and by the indexing of its angular position about its axis, so as to move the "active" spindle—that where the winding of the device takes place—away from the periphery of the device for the positioning and guidance of the thread, so as to preserve a controlled geometry.

The winding is active, and the primary stroke and secondary stroke movements, and the control of the position and/or of the angular speed of the barrel, are controlled by the control and command device 14, so as to conform to the law of construction. This is made possible by the use of a digital technology which makes it possible to fix the position and/or speed of all of the actuators.

We claim:

1. A winding machine, comprising:

a frame including a barrel positioned on the frame;

at least two spindles fastened to the barrel, each of the spindles being configured to support at least one cake and to be movable in rotation about a first axis substantially perpendicular to a diameter of the cake;

a thread drawer including at least two motor-driven rollers configured to hold at least one thread at a first position before the thread is attached to any of the at least two spindles, the rollers being fastened to the frame of the winding machine at a position directly below the at least two spindles;

a straight ejector positioned above the at least two spindles and configured to move the thread from the first position to a second position such that the thread is attached to one of the spindles;

at least one positioning and guidance device configured to move the at least one thread with a primary stroke movement to position and guide the at least one thread on the spindles;

a linear actuator configured to continuously drive the spindles in a secondary stroke movement simultaneously with the primary stroke movement to wind the cake such that the spindles move linearly in forward and reverse directions along the first axis during winding of the at least one thread;

a thread retraction device positioned above the at least one positioning and guidance device and configured to displace the at least one thread by grasping the thread and rotating between the second position, in which the at least one thread is attached to the one of the spindles and retracted from the positioning and guidance device, and a third position, in which the at least one thread is engaged with the positioning and guidance device;

a control and command device to regulate speed and/or position between the primary stroke movement of the positioning and guidance device and the secondary stroke movement of at least one of the spindles; and an indexing device configured to modify continuously an angular position of the barrel with respect to the frame as a function of a variation in outside diameter of the cake, to keep a path of the thread constant between its exit point from the positioning and guidance device and its contact point on a periphery of the cake, wherein the barrel is mounted movably in rotation with respect to the frame along a third axis of rotation substantially parallel to the first axis.

2. The winding machine as claimed in claim 1, wherein the positioning and guidance device includes at least one helix mounted movably in rotation about a second axis, substantially parallel to the first axis.

3. The winding machine as claimed in claim 1, wherein the thread overlaps a distal end of the one of the spindles when the thread is held at the first position.

4. The winding machine as claimed in claim 1, wherein two of the positioning and guidance devices overlap the spindles in a lengthwise direction.

5. A method for winding cakes, comprising:

positioning a first spindle and a second spindle on a barrel located within a frame;

rotating the barrel so that the first spindle is in a thread receiving position;

holding at least one thread at a first position with rollers before the thread is attached to the first spindle or the second spindle, the rollers being fastened to the frame of the winding machine at a position directly below the first spindle and the second spindle;

moving the thread from the first position to a second position with a straight ejector positioned above the first spindle and the second spindle such that the thread is attached to the first spindle;

grasping the thread with a thread retraction device positioned above a positioning and guidance device and rotating the thread retraction device grasping the thread between the second position, in which the thread is attached to the first spindle and retracted from the positioning and guidance device, and a third position, in which the thread is engaged with the positioning and guidance device;

rotating the first spindle having the thread attached thereto around a first axis;

guiding and positioning the thread onto the first spindle with a primary stroke movement of the positioning and guidance device;

driving continuously the first spindle in a secondary stroke movement simultaneously with the primary stroke movement to wind one of the cakes onto the first spindle such that the first spindle moves linearly in forward and reverse directions along the first axis while the first spindle is in the thread receiving position;

regulating speed and/or position between the primary stroke movement of the positioning and guidance device and the secondary stroke movement of at least the first spindle;

modifying continuously an angular position of the barrel with respect to the frame as a function of a variation in an outside diameter of a cake formed on the first spindle, to keep a path of the thread constant between its exit point from the positioning and guidance device and its contact point on a periphery of the cake; and after the driving the first spindle linearly in the forward and reverse directions, rotating the barrel so that the second spindle is in the thread receiving position.

6. The method for winding cakes as claimed in claim 5, wherein the thread overlaps a distal end of the first spindle when the thread is held at the first position.

7. The method for winding cakes as claimed in claim 5, wherein two of the positioning and guidance devices overlap the spindles in a lengthwise direction.

* * * * *